US005452641A

United States Patent [19]

Kariya

[11] Patent Number: 5,452,641

[45] Date of Patent: Sep. 26, 1995

[54] TRANSPARENT ARMOR PIERCING PROTECTION SYSTEM

[75] Inventor: Brian H. Kariya, Los Gatos, Calif.

[73] Assignee: FMC Corporation, Chicago, Ill.

[21] Appl. No.: 224,469

[22] Filed: Apr. 7, 1994

[51] Int. Cl.[6] ..... F41H 5/26

[52] U.S. Cl. ..... 89/36.14; 89/36.02; 109/78

[58] Field of Search ..... 89/36.02, 36.04, 89/36.14, 36.13, 36.14, 36.15, 36.01, 36.08; 109/13, 5, 78, 80, 15, 16

[56] References Cited

U.S. PATENT DOCUMENTS

| | | | |
|---|---|---|---|
| 1,859,013 | 5/1932 | Wise | 109/21.5 |
| 2,392,215 | 1/1946 | Abrams et al. | 109/21.5 |
| 3,917,891 | 11/1975 | Cooke et al. | 89/36.02 |
| 4,005,662 | 2/1977 | Kohn et al. | 109/16 |
| 4,170,947 | 10/1979 | Morgan | 109/16 |

FOREIGN PATENT DOCUMENTS

| | | | |
|---|---|---|---|
| 152889 | 8/1959 | Sweden | 89/36.02 |

*Primary Examiner*—Stephen M. Johnson
*Attorney, Agent, or Firm*—Michael Lee; R. C. Kamp

[57] ABSTRACT

An improved transparent armor piercing protection system that acts as a vision window in an armor system. The transparent armor piercing protection system comprises angled louvers with mirror surfaces in an aperture in armor. A sheet of transparent material is also provided adjacent to the aperture.

17 Claims, 2 Drawing Sheets

TRANSPARENT ARMOR PIERCING PROTECTION SYSTEM

In the prior art, a single thick piece of plastic was used to provide a transparent protective armor, that one could see through. Such conventional transparent protective armor is not practical for protecting against armor piercing projectiles.

The invention provides a transparent armor piercing protection system, that protects against armor piercing projectiles. The invention provides a space efficient and mass efficient transparent armor piercing protection system.

DESCRIPTION OF THE PREFERRED EMBODIMENT

Figure 2:
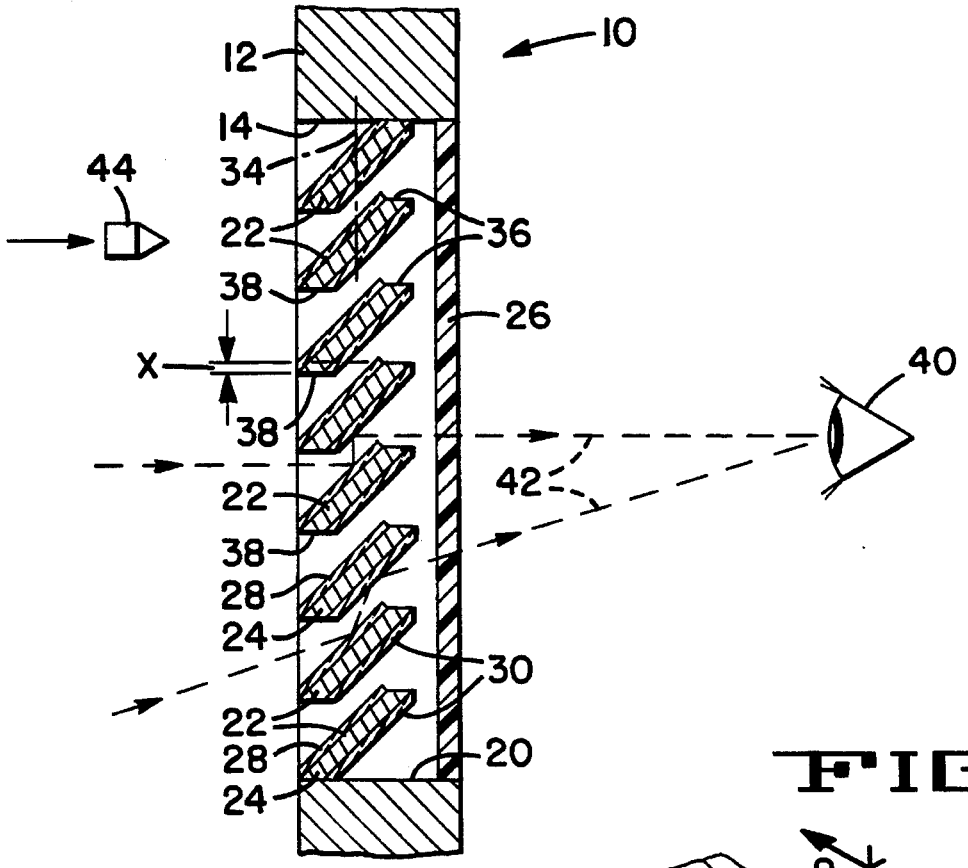
FIG. 2 is a cross-sectional view of the transparent armor piercing protection system shown in FIG. 1 along lines 2—2.
Figure 1:
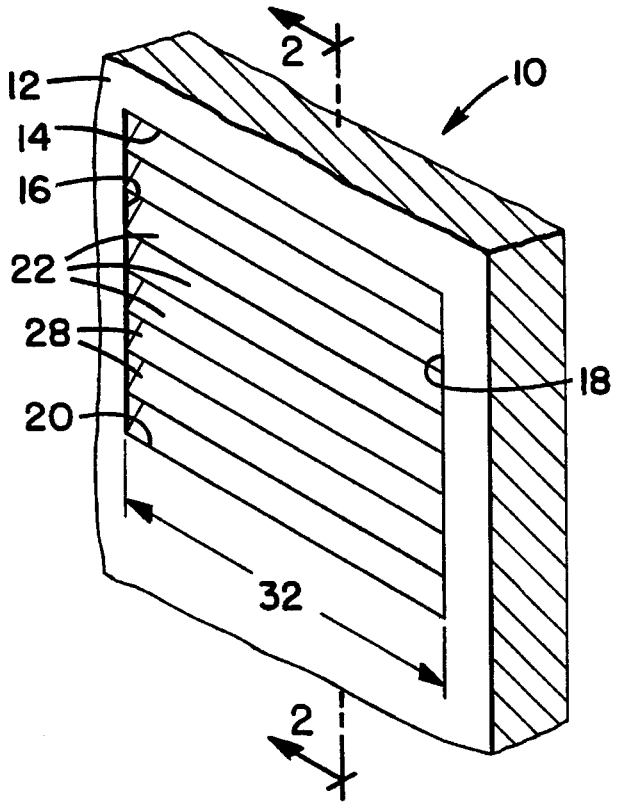
FIG. 1 is a perspective view of the inventive transparent armor piercing protection system, surrounded by conventional armor, so that the transparent armor piercing protection system forms a window.

FIG. 1 is a perspective view of the inventive transparent armor piercing protection system 10 surrounded by conventional armor 12, forming a window in an armor vehicle. FIG. 2 is a cross-sectional view of the armor shown in FIG. 1 along lines 2—2. In the preferred embodiment, the conventional armor 12 forms a rectangular aperture forming a top edge 14, a first side edge 16, a second side edge 18, and a bottom edge 20. The conventional armor 12 could be any conventional armor system or material, such as concrete, ceramics, composites or metallics.

Figure 3:
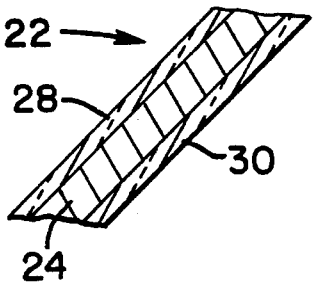
FIG. 3 is an enlarged view of the transparent armor piercing protection system shown in FIG. 2.

The transparent armor piercing protection system 10 comprises a plurality of multiple ballistic louvers 22 with optically reflective surfaces, and a sheet of thick transparent material 26. FIG. 3 is an enlarged view of part of a cross-section of a louver 22. The louver 22 is formed by an armor slat 24, which is strong enough to shatter desired armor piercing projectiles. The armor slat 24 has a first surface and a second surface. The first surface of the armor slat 24 has a first reflective coating 28, which provides a first optical quality reflective (mirror) surface, The second surface of the armor slat has a second reflective coating 30, which provides a second optical quality reflective (mirror) surface. A plurality of louvers 22 extend from the first side edge 16 to the second side edge 18. The louvers 22 are supported by the first and second side edges 16, 18. The louvers 22 are spaced apart from each other and are parallel to each other as shown in FIGS. 1 and 2. Each louver 22 has a length 32. The louvers 22 are defined as parallel when there exists lengths 32 of the louvers 22 that are parallel. The louvers 22 are also angled. The louvers 22 are defined as angled when the reflective surfaces of the louvers 22 are not parallel to any plane 34, which passes through a plurality of louvers 22. Each louver 22 in addition has a first edge 36 and a second edge 38. The first edge 36 of a louver 22 overlaps with a second edge 38 of an adjacent louver 22 by art amount X as shown in FIG. 2. In one embodiment of the invention, the overlap X is 1 cm. In the preferred embodiment, the reflective surfaces of the louvers 22 form a 45° angle with a plane that passes through a plurality of louvers 22. In this embodiment, the first edges 36 and the second edges 38 are perpendicular to a plane that passes through a plurality of louvers 22.

The sheet of transparent material 26 is placed spaced a part from the louvers 22 and is supported by the top edge 14, first side edge 16, second side edge 18, and bottom edge 20 of the aperture in the conventional armor 12. In an embodiment, the sheet of transparent material 26 is a glass/plastic laminate. The sheet of transparent material could be any conventional transparent armor, which is ballistically adequate to contain spallation from specified threat levels.

In the operation of the invention, a vehicle operator 40 is protected by the conventional armor 12 which supports the inventive transparent armor 10, forming a window allowing the operator to see outside of the vehicle. Line of sight lines 42 indicate how light would be reflected off a first reflective coating 28 of one louver 22 and the second reflective coating 30 of an adjacent louver 22 between the outside of the vehicle and the operator 40. Because the louvers 22 provide a reflected beam of light that is parallel to the incident beam of light, the louvers 22 allow the operator 40 to have an undistorted view of the outside, through the inventive transparent armor. If a projectile 44 is directed at the inventive transparent armor 10, the projectile 44 will strike the louvers 22 which will either stop the projectile 44 or cause it to fragment and/or destabilize. The remaining fragments of the projectile 44 will be stopped by the sheet of transparent material 26. The louvers 22 are angled so that in order for a projectile 22 to be angled so that it may not encounter the louvers 22, the projectile 44 would need to come from a location very close to the vehicle, so that such a projectile 44 would be highly improbable.

Figure 4:
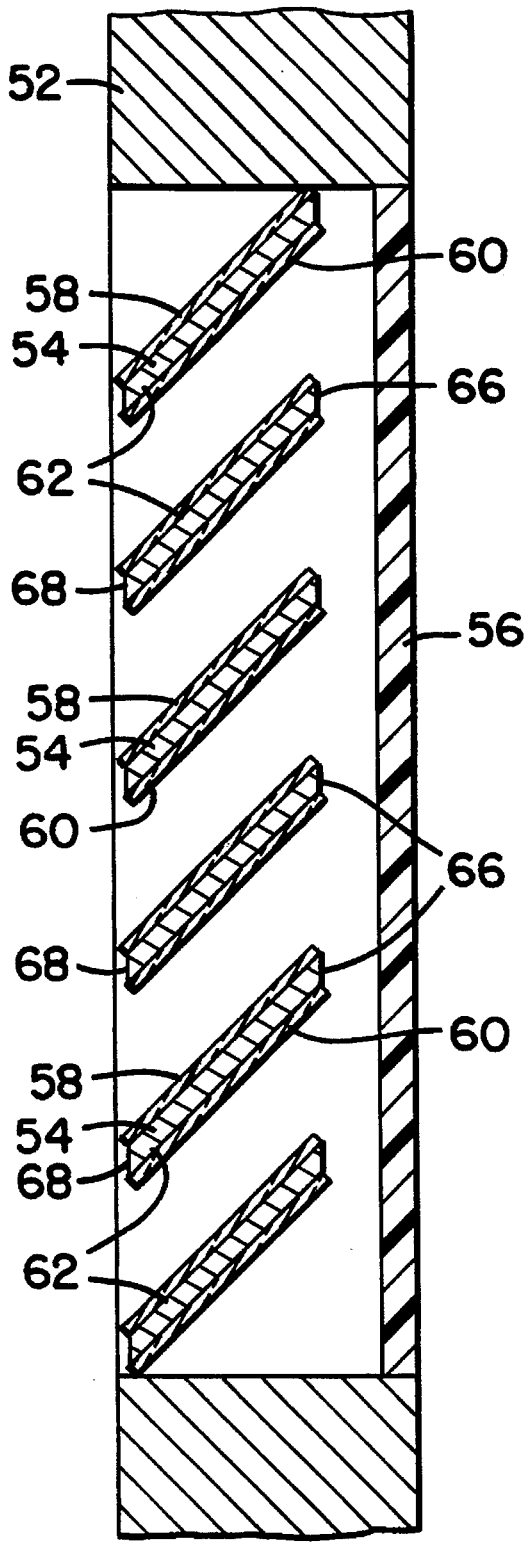
FIG. 4 is a cross-sectional view of another embodiment of the transparent armor piercing protection system.

FIG. 4 is a cross-sectional view of another embodiment of the invention. In this embodiment a plurality of louvers 62 extend across an aperture in conventional armor 52. The louvers 62 have a first reflective coating 58 and a second reflective coating 60 on the surface of an armor slat 54. A sheet of transparent material 56 is placed spaced a part from the louvers 62 and is supported by the armor 52. In this embodiment, the louvers 62 have a first edge 66 and a second edge 68 which are parallel to a plain that passes through a plurality of louvers 62. This embodiment extends the second reflective coating 60 away from the transparent material 56, and extends the first reflective coating 58 towards the transparent material.

Other embodiments may use additional sets of louvers.

Although the best mode contemplated for carrying out the present invention has been herein shown and described, it will be understood that modification and variation may be made without departing from what is regarded to be the subject matter of the invention.

What is claimed is:

1. An apparatus, comprising: armor with an aperture;

a plurality of louvers supported by the armor in the aperture, wherein each said louver has a first surface and a second surface and wherein the first surface and the second surfaces are mirror surfaces; and a sheet of transparent material supported by the armor and adjacent to the plurality of louvers.

2. The apparatus, as recited in claim 1, wherein the plurality of louvers extend from a first edge to a second edge of the aperture, and wherein the louvers are parallel to each other and angled with respect to any plane that passes through the plurality of louvers.

3. The apparatus as recited in claim 1, wherein the louvers overlap with each other.

4. The apparatus, as recited in claim 2, wherein the sheet of transparent material extends from the first edge to the second edge of the aperture.

5. The apparatus, as recited in claim 4, wherein the louvers overlap with each other.

6. The apparatus, as recited in claim 4, wherein the transparent material is plastic.

7. The apparatus, as recited in claim 4, wherein the transparent material is laminated glass.

8. The apparatus as recited in claim 5, wherein the louvers contain an armor slat with a strength sufficient to fragment an armor piercing projectile.

9. The apparatus, as recited in claim 8, wherein the louvers are angle 45° from a plane that passes through said plurality of louvers.

10. The apparatus, as recited in claim 9, wherein the louvers have edges which are parallel to a plane that passes through said plurality of louvers.

11. The apparatus, as recited in claim 9, wherein the louvers have edges which are perpendicular to a plane that passes through said plurality of louvers.

12. The apparatus, as recited in claim 9, where the louvers overlap with each other at least 1 centimeter.

13. A transparent armor piercing projectile protection system, comprising:

a plurality of louvers, wherein each louver has a first surface and a second surface and wherein the first surface and the second surfaces are mirror surfaces; and a sheet of transparent material spaced apart from and adjacent to the plurality of louvers.

14. The system, as recited in claim 13, wherein the louvers are flat and parallel to each other and angled with respect to any plane that passes through the plurality of louvers.

15. The system, as recited in claim 14, wherein the louvers overlap with each other.

16. The system as recited in claim 15, wherein the louvers contain an armor slat with a strength sufficient to fragment an armor piercing projectile.

17. The system, as recited in claim 16, wherein the louvers are angle 45° from a plane that passes through said plurality of louvers.

* * * * *